US007980214B2

(12) United States Patent
Inoue

(10) Patent No.: US 7,980,214 B2
(45) Date of Patent: Jul. 19, 2011

(54) CONTROL DEVICE FOR ELECTRICALLY DRIVEN VARIABLE VALVE TIMING APPARATUS

(75) Inventor: Masaomi Inoue, Kariya (JP)

(73) Assignee: Denso Corporation, Kariya (JP)

( * ) Notice: Subject to any disclaimer, the term of this patent is extended or adjusted under 35 U.S.C. 154(b) by 431 days.

(21) Appl. No.: 12/081,281

(22) Filed: Apr. 14, 2008

(65) Prior Publication Data

US 2008/0257292 A1 Oct. 23, 2008

(30) Foreign Application Priority Data

Apr. 17, 2007 (JP) ..... 2007-107740

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,055,957 A 5/2000 Hasegawa et al.
2006/0037568 A1 * 2/2006 Arinaga et al. ..... 123/90.15
2006/0042578 A1 3/2006 Izumi et al.
2006/0042579 A1 3/2006 Izumi et al.
2009/0048764 A1 2/2009 Fuwa

FOREIGN PATENT DOCUMENTS

JP 08303168 A * 11/1996
JP 2004-300924 10/2004
JP 2004-340076 12/2004
JP 2005-076617 3/2005
JP 2007-056838 3/2007

OTHER PUBLICATIONS

Abstracct, JP 08303168 A, Nov. 1996.*
Office Action dated Jun. 24, 2010 issued in corresponding Japanese Application No. 2007-107740 with an at least partial English-language translation thereof.

* cited by examiner

*Primary Examiner* — Zelalem Eshete
(74) *Attorney, Agent, or Firm* — Nixon & Vanderhye P.C.

(57) ABSTRACT

At time of starting an engine, stop/rotation of an electric motor is sensed based on presence/absence of output pulses of an encoder installed in the motor. Controlling of power supply to the motor is prohibited to maintain an off-state of the motor until start of rotation of the motor is sensed. When the start of the motor is sensed, the controlling of the power supply to the motor is started. At time of stopping the engine, stop/rotation of the motor is sensed based on time intervals of pulses outputted from the encoder. The controlling of the power supply to the motor is enabled until sensing of stopping of rotation of the motor. When the stopping of rotation of the motor is sensed, the controlling of the power supply to the motor is prohibited to stop the power supply to the motor.

7 Claims, 8 Drawing Sheets

CONTROL DEVICE FOR ELECTRICALLY DRIVEN VARIABLE VALVE TIMING APPARATUS

CROSS REFERENCE TO RELATED APPLICATION

This application is based on and incorporates herein by reference Japanese Patent Application No. 2007-107740 filed on Apr. 17, 2007.

BACKGROUND OF THE INVENTION

1. Field of the Invention

The present invention relates to a control device for an electrically driven variable valve timing apparatus, which uses an electric motor as its drive source.

2. Description of Related Art

Lately, an electric motor is often used as a drive source of a variable valve timing apparatus in place of a hydraulic system to implement a precise variable valve timing control operation that is not affected by a change in a hydraulic pressure of an internal combustion engine. For example, Japanese Unexamined Patent Publication No. 2006-70754 (corresponding to US2006/0042579A1) discloses one such electrically driven variable valve timing apparatus. The variable valve timing apparatus includes a first gear (an outer gear), a second gear (an inner gear), a phase variable gear (a planetary gear) and an electric motor. The first gear is coaxial with the camshaft of the internal combustion engine and is rotated by a rotational drive force of a crankshaft. The second gear is rotated integrally with the camshaft. The phase variable gear revolves along a circular path, which is coaxial with the camshaft. The phase variable gear transmits a rotational force of the first gear to the second gear and changes a rotational phase of the second gear relative to the first gear. The motor is placed coaxially with the camshaft to control a revolving speed of the phase variable gear. The number of teeth of the first gear and the number of teeth of the second gear are set to drive the camshaft at a corresponding rotational speed, which is one half of the rotational speed of the crankshaft. When the valve timing is not changed, the rotational speed of the motor is adjusted to coincide with the rotational speed of the first gear, which is driven by the crankshaft, and the revolving speed of the phase variable gear is adjusted to coincide with the rotational speed of the first gear. Thereby, the current rotational phase difference between the first gear and the second gear is maintained to maintain the current valve timing. In contrast, at the time of changing the valve timing, the rotational speed of the motor is changed relative to the rotational speed of the first gear to change the revolving speed of the phase variable gear relative to the rotational speed of the first gear. Thereby, the rotational phase difference between the first gear and the second gear is changed to change the valve timing.

However, even when the electric power is supplied to the motor during the non-operational state (stop state) of the internal combustion engine, it is difficult to change the actual camshaft phase (the actual valve timing). Therefore, in this state, when the supply of the electric power to the motor is maintained until the time of coinciding the actual camshaft phase with a target camshaft phase, the electric current is kept flowing only through the respective winding of the same phase in the substantially locked state of the motor. As a result, the temperature of the windings of the motor may possibly exceed an allowable temperature range. This may lead to deterioration of the durability of the motor and/or a failure of the motor.

SUMMARY OF THE INVENTION

The present invention addresses the above disadvantages.

According to one aspect of the present invention, there is provided a control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine. The control device includes a control means, a motor rotation sensing means and a power supply prohibiting means. The control means is for controlling power supply to the electric motor to change a rotational speed of the electric motor relative to a rotational speed of the camshaft and thereby to change the rotational phase of the camshaft relative to the crankshaft. The motor rotation sensing means is for sensing stop and rotation of the electric motor. The power supply prohibiting means is for prohibiting the controlling of the power supply to the electric motor by the control means until starting of rotation of the electric motor is sensed based on a result of the sensing of the motor rotation sensing means.

According to another aspect of the present invention, there is provided a control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine. The control device includes a control means, a motor rotation sensing means and a power supply prohibiting means. The control means is for controlling power supply to the electric motor to change a rotational speed of the electric motor relative to a rotational speed of the camshaft and thereby to change the rotational phase of the camshaft relative to the crankshaft. The motor rotation sensing means is for sensing stop and rotation of the electric motor. The power supply prohibiting means is for prohibiting the controlling of the power supply to the electric motor by the control means when stopping of rotation of the electric motor is sensed based on a result of the sensing of the motor rotation sensing means.

According to another aspect of the present invention, there is provided a control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine. The control device includes a control means, a motor rotation sensing means and a power supply prohibiting means. The control means is for controlling power supply to the electric motor to change a rotational speed of the electric motor relative to a rotational speed of the camshaft and thereby to change the rotational phase of the camshaft relative to the crankshaft. The motor rotation sensing means is for sensing stop and rotation of the electric motor. The power supply prohibiting means is for prohibiting the controlling of the power supply to the electric motor by the control means when a predetermined time period elapses upon sensing of stopping of rotation of the electric motor based on a result of the sensing of the motor rotation sensing means.

According to another aspect of the present invention, there is provided a control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine. The control device includes a control means and a power supply enabling means. The control means is for controlling power supply to the electric motor to change a rotational speed of the electric motor relative to a rotational speed of the camshaft and thereby to change the rotational phase of the camshaft relative to the crankshaft. The power supply enabling means is for enabling the controlling of the power supply to the electric motor by the control means when starting of power supply to a starter of the internal combustion engine is sensed.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

A first embodiment of the present invention will be described with reference to FIGS. 1 to 6.

Figure 1:
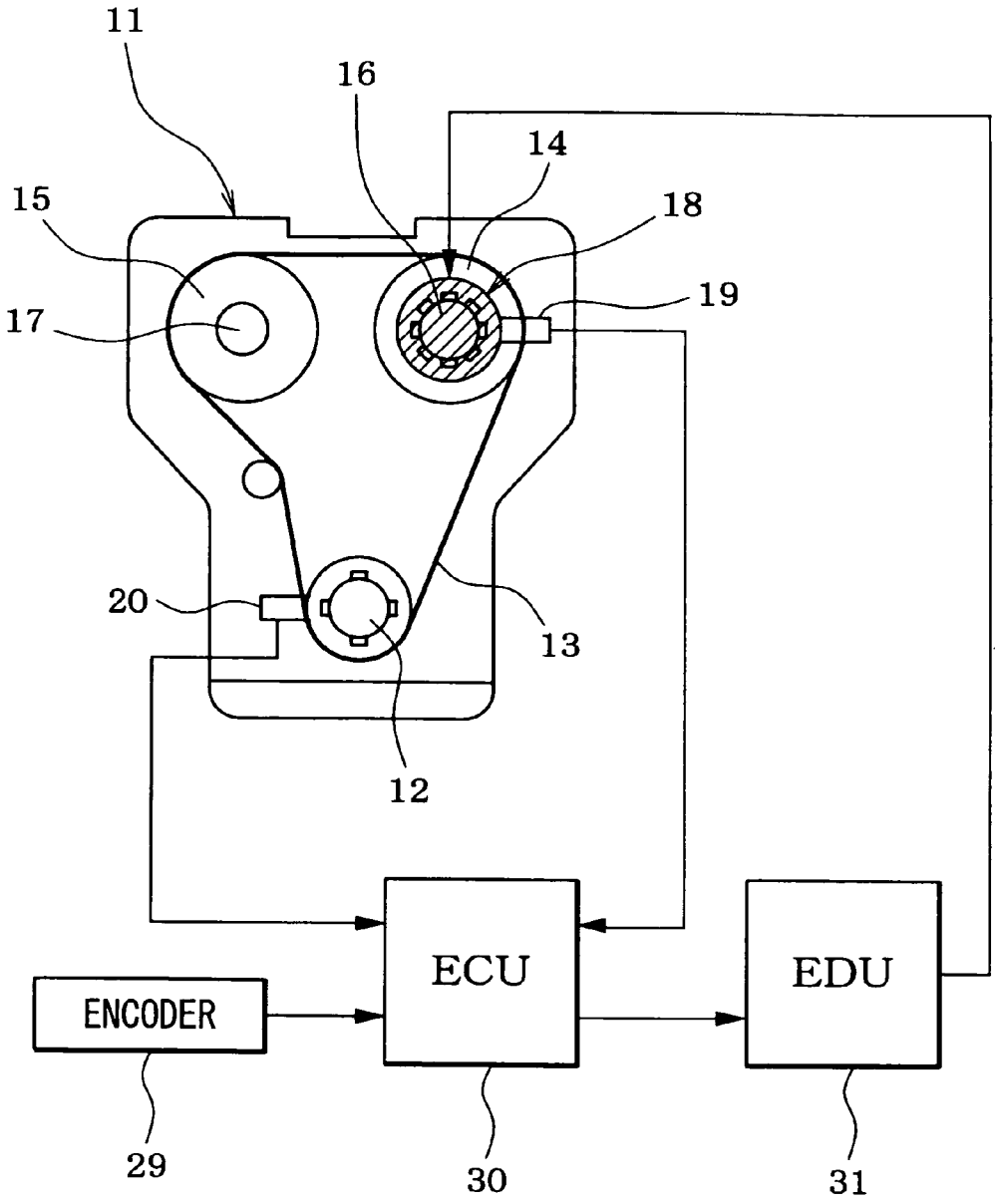
FIG. 1 is a schematic diagram showing an entire control system according to a first embodiment of the present invention.

First, an entire system will be schematically described with reference to FIG. 1.

In an internal combustion engine (hereinafter, simply referred to as an engine) 11, a drive force of a crankshaft 12 is transmitted by a timing chain 13 (or a timing belt) to an intake side camshaft 16 and an exhaust side camshaft 17 through sprockets 14, 15, respectively. Furthermore, an electrically driven variable valve timing apparatus 18 is provided to the intake side camshaft 16. A rotational phase (camshaft phase) of the intake side camshaft 16 relative to the crankshaft 12 is variably set by the variable valve timing apparatus 18, and thereby valve timing of intake valves (not shown), which are opened and closed by the intake side camshaft 16 is also variably set.

Furthermore, a cam angle sensor 19, which outputs a cam angle signal at every predetermined cam angle, is provided radially outward of the intake side camshaft 16. Also, a crank angle sensor 20, which outputs a crank angle signal at every predetermined crank angle, is provided radially outward of the crankshaft 12.

Figure 2:
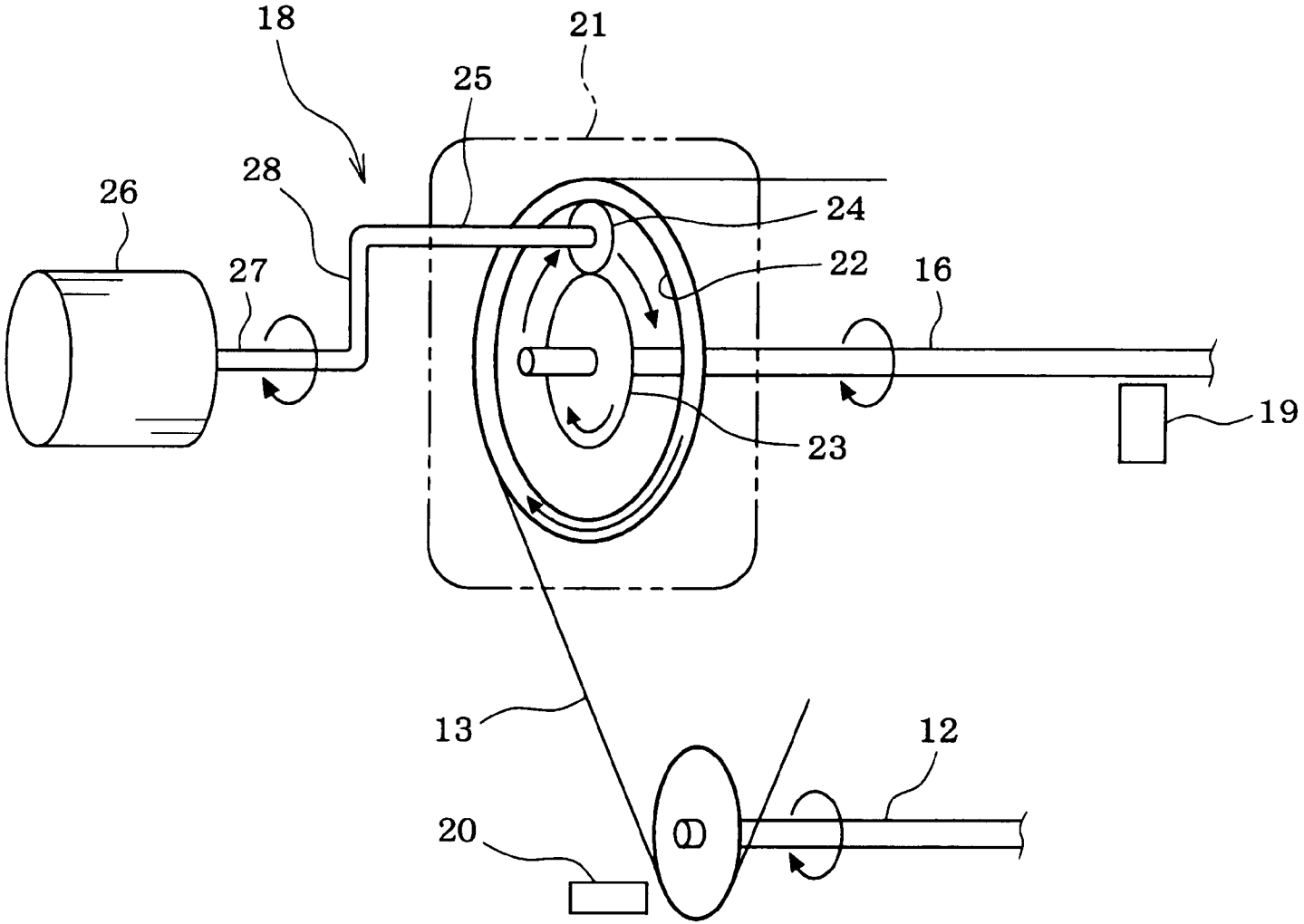
FIG. 2 is a schematic diagram showing a motor driven variable valve timing apparatus of the control system of FIG. 1.

A description will now be made to the schematic structure of the electrically driven variable valve timing apparatus 18 with reference to FIG. 2.

A phase variable mechanism 21 of the variable valve timing apparatus 18 includes an internally toothed outer gear 22 (a first gear), an externally toothed inner gear 23 (a second gear) and a planetary gear 24 (a phase variable gear). The outer gear 22 is coaxial with the intake side camshaft 16. The inner gear 23 is coaxially arranged at radially inward of the outer gear 22. The planetary gear 24 (phase variable gear) is placed between the outer gear 22 and the inner gear 23 and is meshed therebetween. The outer gear 22 is rotated integrally with the sprocket 14, which is rotated synchronously with the crankshaft 12. The inner gear 23 is rotated integrally with the intake side camshaft 16. Furthermore, the planetary gear 24 revolves along a circular path about the inner gear 23 while the planetary gear 24 is meshed with the outer gear 22 and the inner gear 23. Therefore, the planetary gear 24 transmits the rotational force of the outer gear 22 to the inner gear 23, and the revolving speed of the planetary gear 24 relative to the rotational speed of the inner gear 23 (the rotational speed of the intake side camshaft 16) is changed to adjust the rotational phase (camshaft phase) of the inner gear 23 relative to the outer gear 22.

In this case, the number of teeth of the outer gear 22, the number of teeth of the inner gear 23 and the number of teeth of the planetary gear 24 are set such that the intake side camshaft 16 is rotated at a rotational speed, which is one half of the rotational speed of the crankshaft 12 as expressed by the following equation.

$$\text{Rotational Speed of Intake Side Camshaft} = \text{Rotational Speed of Crankshaft} \times \tfrac{1}{2}$$

An electric motor 26 is provided to the engine 11 to change the revolving speed of the planetary gear 24. A rotatable shaft 27 of the motor 26 is coaxial with the intake side camshaft 16, the outer gear 22 and the inner gear 23. The rotatable shaft 27 of the motor 26 and a support shaft 25 are interconnected through a connecting member 28, which extends in a radial direction. In this way, when the motor 26 rotates, the planetary gear 24 revolves along the circular path at radially outward of the inner gear 23 while the planetary gear 24 rotates about the support shaft 25. Furthermore, an encoder 29 (a motor rotation sensing means) is installed to the motor 26. The encoder 29 outputs a pulse at every predetermined rotational angle synchronously with the rotation of the motor 26. A rotational angle (the amount of rotation) of the motor 26 is sensed by counting the output pulses of the encoder 29.

The variable valve timing apparatus 18 is constructed such that the rotatable shaft 27 of the motor 26 rotates synchronously with the intake side camshaft 16 in the non-operational state of the motor 26. In a state where the rotational speed of the motor 26 coincides with the rotational speed of the intake side camshaft 16 (the rotational speed of the crankshaft 12×½) while the revolving speed of the planetary gear 24 coincides with the rotational speed of the inner gear 23 (the rotational speed of the outer gear 22), a current rotational phase difference between the outer gear 22 and the inner gear 23 is maintained to maintain the current valve timing (the camshaft phase).

At the time of advancing the valve timing of the intake valves, the rotational speed of the motor 26 is increased in comparison to the rotational speed of the intake side camshaft 16, and the revolving speed of the planetary gear 24 is increased in comparison to the rotational speed of the inner gear 23. In this way, the rotational phase of the inner gear 23 relative to the outer gear 22 is advanced, so that the valve timing (the camshaft phase) is advanced.

At the time of retarding the valve timing of the intake valves, the rotational speed of the motor 26 is decreased in comparison to the rotational speed of the intake side camshaft 16, and the revolving speed of the planetary gear 24 is reduced in comparison to the rotational speed of the inner gear 23. In this way, the rotational phase of the inner gear 23 relative to the outer gear 22 is retarded, so that the valve timing (the camshaft phase) is retarded.

Outputs of the above-described sensors are supplied to an engine control unit (ECU) 30. The ECU 30 includes a microcomputer as its main component. When the ECU 30 executes engine control programs, which are stored in a ROM (a storage) of the ECU 30, a fuel injection quantity of each fuel injection valve (not shown) and ignition timing of a corresponding spark plug (not shown) are controlled.

Furthermore, the ECU 30 computes a rotational phase (an actual camshaft phase) of the camshaft 16 relative to the crankshaft 12 based on the output signal of the cam angle sensor 19 and the output signal of the crank angle sensor 20. The ECU 30 also computes a target camshaft phase based on the engine operational condition. Then, the ECU 30 computes a target motor rotational speed based on a difference between the target camshaft phase (the target valve timing) and the actual camshaft phase (the actual valve timing) as well as the engine rotational speed. Thereafter, the ECU 30 outputs a signal of the computed target motor rotational speed to a motor drive control unit (EDU) 31.

The EDU 31 functions as a control means of the present invention. The EDU 31 executes a feedback control operation to control a duty of a voltage applied to the motor 26 such that the difference between the target motor rotational speed and the actual motor rotational speed becomes relatively small, so that the actual camshaft phase is controlled to the target camshaft phase. The above function of the EDU 31 may be incorporated into the ECU 30 in some cases.

Furthermore, the ECU 30 executes a motor power supply start timing determination routine of FIG. 3 described below. Thereby, the ECU 30 senses stop/rotation of the motor 26 based on presence/absence of the output pulse of the encoder 29. The ECU 30 prohibits a power supply control operation (a duty control operation) of the motor 26 to maintain the power supply off state of the motor 26 until the time of sensing the start of the rotation of the motor 26. The ECU 30 starts (enables) the power supply control operation of the motor 26 when the start of the rotation of the motor 26 is sensed.

Furthermore, the ECU 30 executes a motor power supply stop timing determination routine of FIG. 5 described below. Thereby, the ECU 30 senses the stop/rotation of the motor 26 based on the motor rotational speed, which is obtained from the time intervals of the pulses outputted from the encoder 29. The ECU 30 enables the power supply control operation of the motor 26 until the time of sensing the stop of the rotation of the motor 26. The ECU 30 prohibits (disables) the power supply control operation of the motor 26 to stop (turn off) the motor 26 when the stop of the rotation of the motor 26 is sensed. Now, details of the above routines of FIGS. 3 and 5 will be described.

Figure 3:
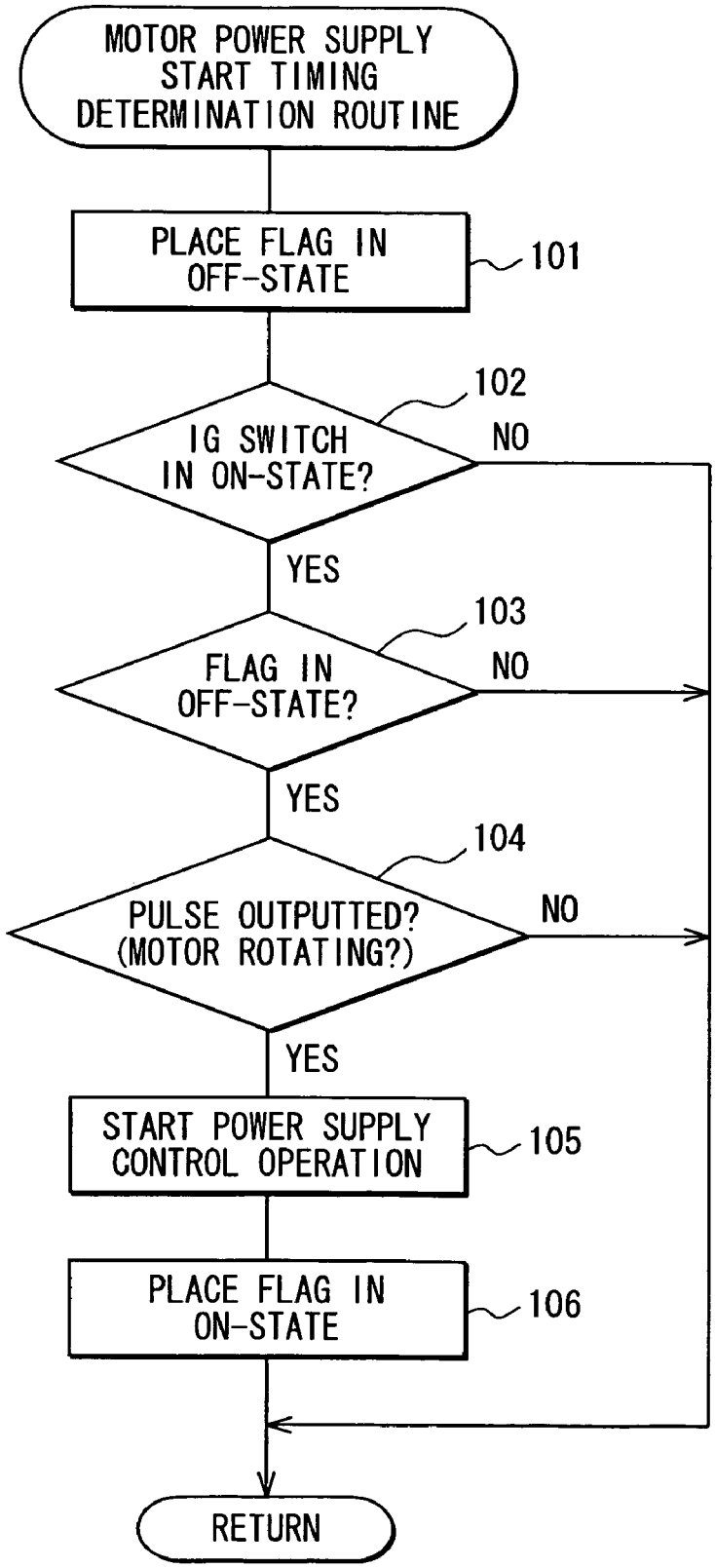
FIG. 3 is a flowchart showing a flow of a motor power supply start timing determination routine of the first embodiment.

The motor power supply start timing determination routine of FIG. 3 is executed at predetermined intervals during a power source on-state period (during an on-state period of a power source main relay) and serves as a motor rotation sensing means and a power supply prohibiting means. Upon starting of this routine, at step 101, a power supply history flag is placed in an off-state at the time of placing an ignition switch (hereinafter, denoted as an IG switch) into an on-state first time. Then, at step 102, it is determined whether the IG switch is in the on-state. When it is determined that the IG switch is in an off-state at step 102, it is obvious that a variable valve timing control operation is not required, so that the present routine is terminated without executing any of the following steps.

In contrast, when it is determined that the IG switch is placed in the on-state at step 102, the ECU 30 proceeds to step 103. At step 103, it is determined whether the power supply history flag is in the off-state (i.e., before the start of the power supply to the motor 26). When it is determined that the power supply history flag is in the on-state (i.e., after the start of the power supply to the motor 26) at step 103, the ECU 30 terminates the present routine without executing any of the following steps.

In contrast, when it is determined that the power supply history flag is in the off-state (i.e., before the start of the power supply to the motor 26) at step 103, the ECU 30 proceeds to step 104. At step 104, it is determined whether the motor 26 is currently in the rotating state based on the presence/absence of output of the pulse from the encoder 29. When the pulse is not outputted from the encoder 29, the ECU 30 determines that the motor 26 is in the stop state at step 104, so that the ECU 30 terminates the present routine without executing any of the following steps.

When it is determined that the pulse is outputted from the encoder 29 at step 104, the ECU 30 determines that the rotation of the motor 26 has been started and proceeds to step 105. At step 105, the ECU 30 starts the power supply control operation (the duty control operation) of the motor 26 and proceeds to step 106. At step 106, the ECU 30 sets the power supply history flag into the on-state and terminates the present routine.

Figure 4:
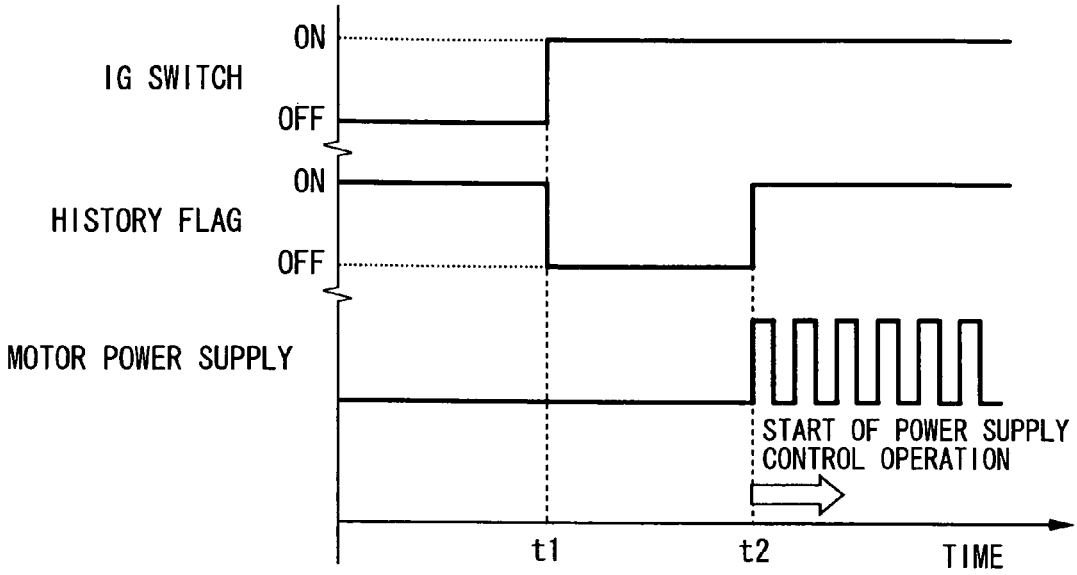
FIG. 4 is a time chart for describing a control method of motor power supply start timing according to the first embodiment.

An example of the motor power supply start timing determination routine of FIG. 3 will be described with reference to a time chart of FIG. 4. In the example of FIG. 4, at time t1, at which the IG switch is changed from the off-state to the on-state, the power supply history flag is changed from the on-sate to the off-state. Thereafter, the power supply control operation (the duty control operation) of the motor 26 is prohibited to maintain the power supply off-state of the motor 26 until the time of sensing the pulse of the encoder 29 (until the time of sensing the rotation of the motor 26). At the time t2, at which the pulse of the encoder 29 is sensed, the ECU 30 determines that the rotation of the motor 26 has started, so that the ECU 30 changes the power supply history flag to the on-state to start the power supply control operation (the duty control operation) of the motor 26.

Figure 5:
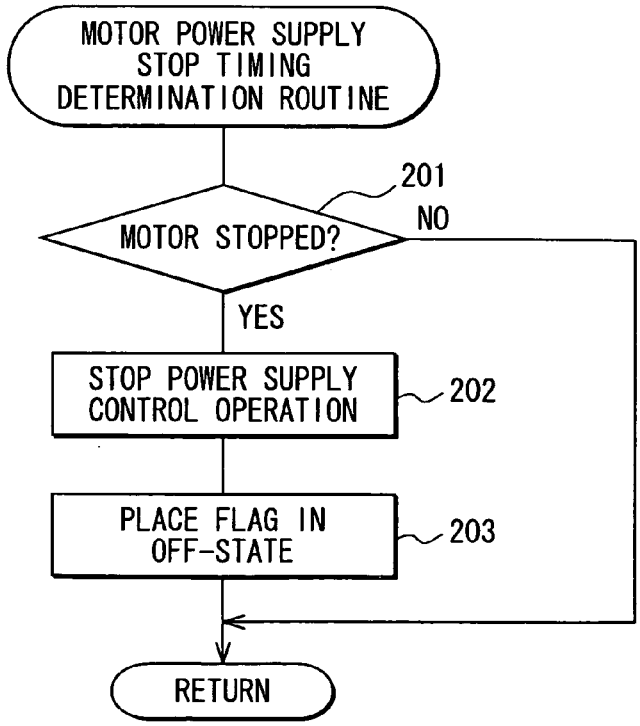
FIG. 5 is a flowchart showing a flow of a motor power supply stop timing determination routine of the first embodiment.

The motor power supply stop timing determination routine of FIG. 5 is executed at predetermined intervals during the power source on-state period (during the on-state period of the power source main relay) and serves as a motor rotation sensing means and a power supply prohibiting means. Upon starting of the present routine, at step 201, it is determined whether the motor 26 is in the rotation stop state. This is determined based on whether the rotational speed of the motor 26, which is obtained from the time intervals of the pulses outputted from the encoder 29, is equal to or less than a stop determination value. When it is determined that the motor 26 is in the rotating state at step 201, the ECU 30 terminates the present routine without executing any of the following steps.

In contrast, when it is determined that the motor 26 is in the stop state at step 201, the ECU 30 proceeds to step 202. At step 202, the ECU 30 stops (prohibits) the power supply control operation of the motor 26 and proceeds to step 203. At step 203, the ECU 30 places the power supply history flag into the off-state and terminates the present routine.

Figure 6:
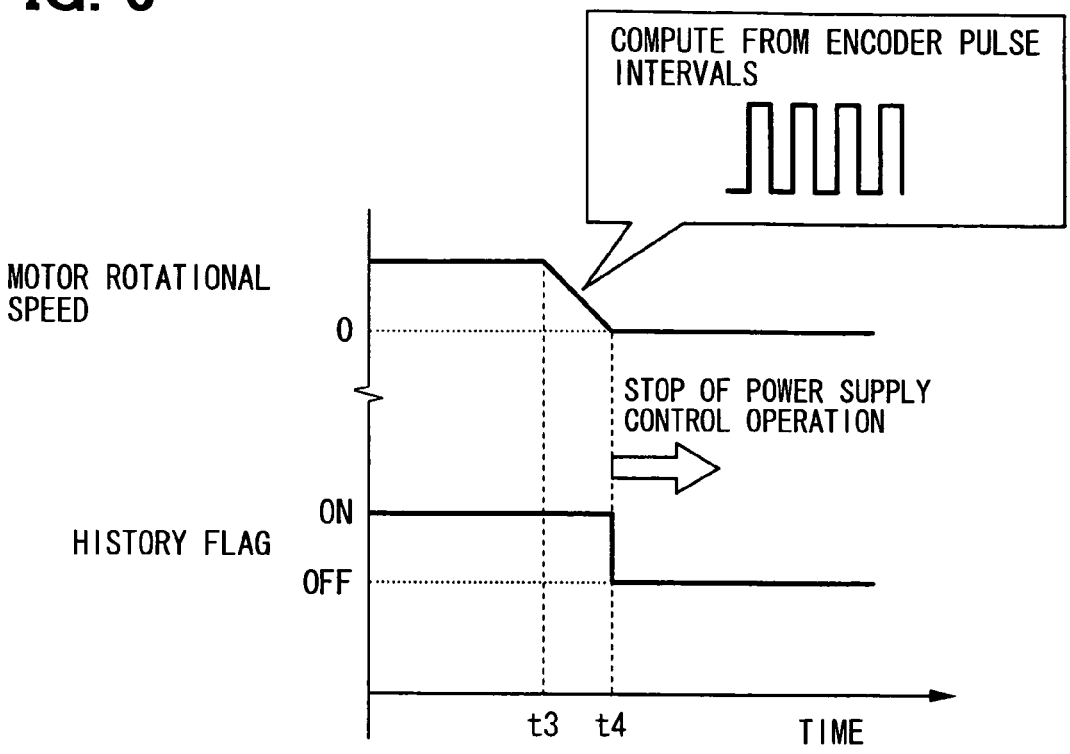
FIG. 6 is a time chart for describing a control method of motor power supply stop timing according to the first embodiment.

An example of the motor power supply stop timing determination routine of FIG. 5 will be described with reference to a time chart of FIG. 6. In the example of FIG. 6, at the time t3, the IG switch is placed in the off-state, so that the fuel injection and ignition are stopped. Thereby, the rotational speed of the engine 11 is reduced, and the rotational speed of the motor 26 is also reduced. In this way, at the time t4, at which the rotational speed of the motor 26 that is obtained from the time intervals of the pulses outputted from the encoder 29 becomes equal to or less than the stop determination value, the ECU 30 determines that the rotation of the motor 26 has been stopped. Thus, the ECU 30 places the power supply history flag into the off-state and stops (prohibits) the power supply control operation of the motor 26.

In the first embodiment, the power supply control operation of the motor 26 is prohibited until the time of sensing the start of the rotation of the motor 26 based on the presence/absence of the output pulse of the encoder 29. Therefore, the power supply off-state of the motor 26 can be maintained until the time of starting of the rotation of the motor 26 in response to the rise of the rotation of the engine 11 at the time of engine start. In this way, it is possible to limit the overheating of the motor 26 caused by continuous power supply to the motor 26 in the stop state of the engine 11. As a result, it is possible to limit a deterioration in the durability of the motor 26 and occurrence of a failure of the motor 26.

It is conceivable to start the power supply control operation of the motor 26 after the sensing of the start of the rotation of the engine 11 at the time of engine start. However, the start of the rotation of the engine 11 is sensed based on the crank pulse outputted from the crank angle sensor at every predetermined crank angle (e.g., every 30 degree crank angle), so that the timing of sensing the start of the engine 11 is delayed. Thus, the timing of starting the power supply control operation of the motor 26 (the variable valve timing control operation) is disadvantageously delayed at the time of engine start.

In contrast, according to the first embodiment, the power supply control operation of the motor 26 is started after the sensing of the start of the rotation of the motor 26. Thus, in comparison to the case where the start of the rotation of the engine 11 is sensed based on the crank pulse, the power supply control operation of the motor 26 (the variable valve timing control operation) can be advantageously started at the early stage according to the first embodiment.

Furthermore, according to the first embodiment, it is determined whether the rotation of the motor 26 is stopped based on the rotational speed of the motor 26, which is obtained from the time intervals of the pulses that are outputted from the encoder 29. When the stop of the rotation of the motor 26 is sensed, the power supply control operation of the motor 26 is stopped. Thus, when the rotation of the engine 11 is stopped to stop the rotation of the motor 26, the power supply control operation of the motor 26 can be stopped.

In the first embodiment, the stop of the rotation of the motor 26 is sensed based on whether the rotational speed of the motor 26, which is obtained from the time intervals of the pulses outputted from the encoder 29, is equal to or less than the stop determination value. Alternatively, the stop of the rotation of the motor 26 may be sensed based on whether the time interval of the pulses outputted from the encoder 29 is equal to or larger than a corresponding determination value.

Also, in place of the encoder 29, any other suitable rotation sensor, which is other than the encoder 29, may be used.

Second Embodiment

Figure 8:
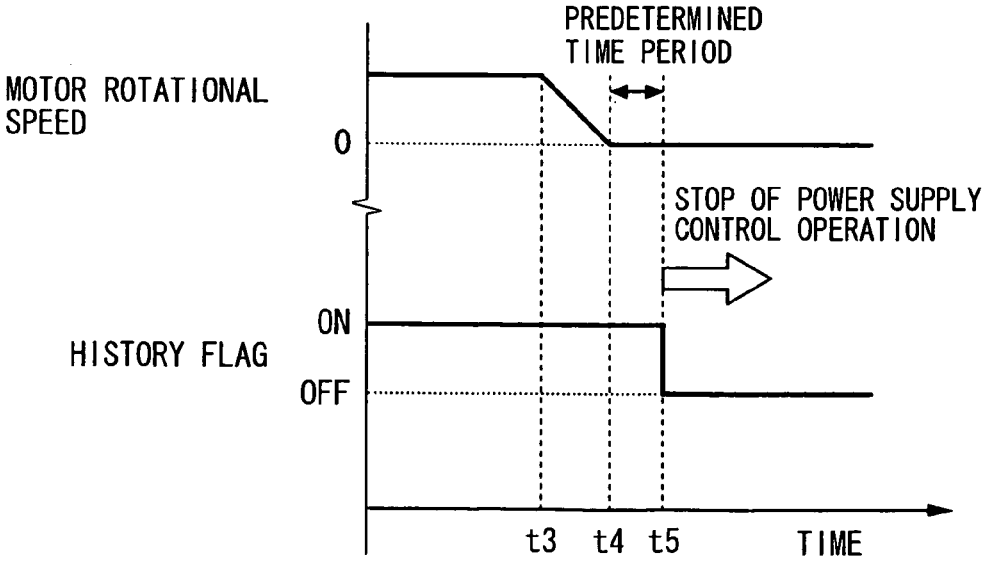
FIG. 8 is a time chart for describing a control method of motor power supply stop timing according to the second embodiment.

In the first embodiment, when the stop of the rotation of the motor 26 is sensed, the power supply control operation of the motor 26 is stopped (prohibited). In contrast, according to a second embodiment of the present invention shown in FIGS. 7 and 8, the power supply control operation of the motor 26 is stopped when a predetermined time period elapses from the time of sensing the stop of the rotation of the motor 26, which is sensed based on the output pulses of the encoder 29. Here, the predetermined time period of maintaining the power supply control operation after the time of sensing the stop of the rotation of the motor 26 may be set within a range that does not cause exceeding of the temperature of the windings of the motor 26 beyond an allowable temperature range.

Figure 7:
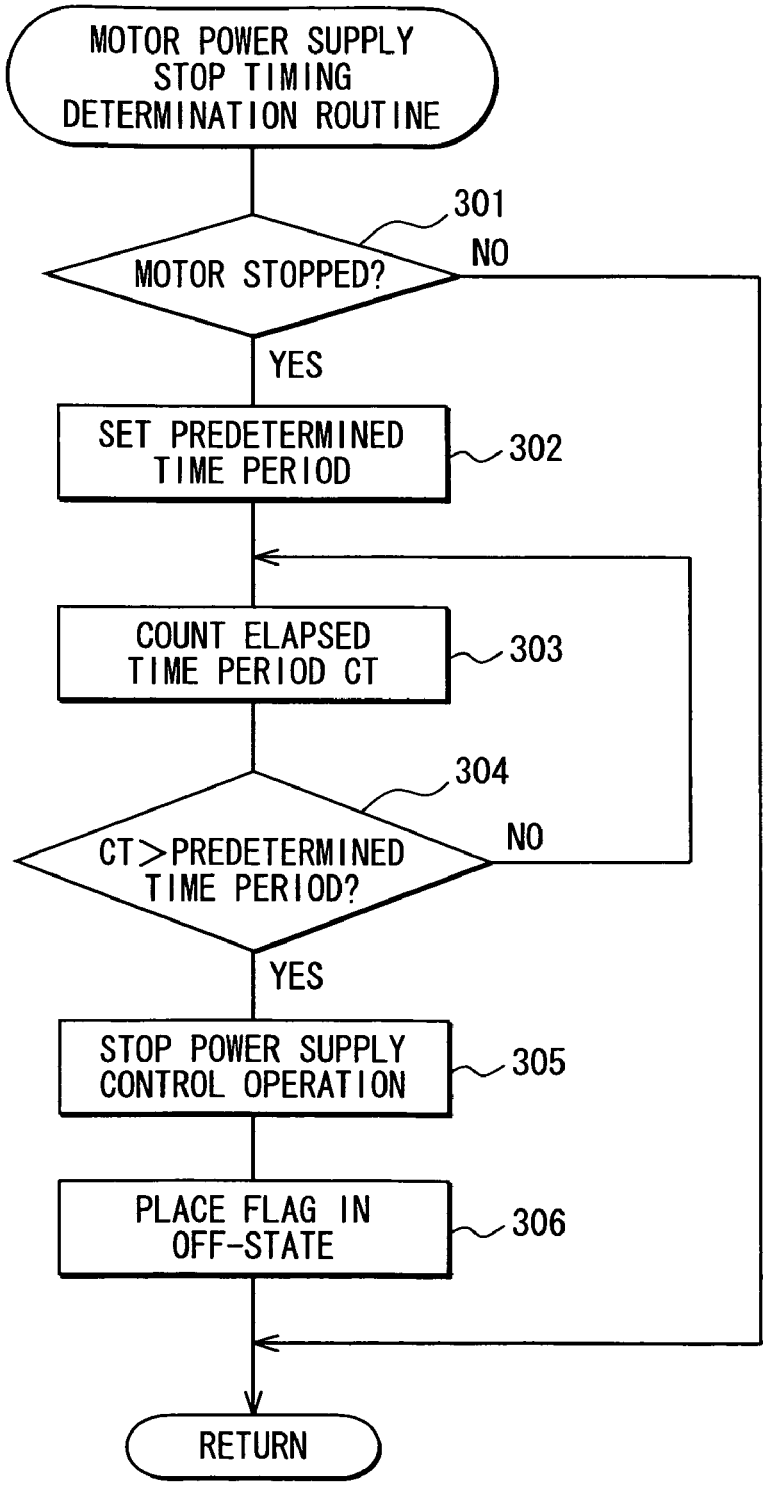
FIG. 7 is a flowchart showing a flow of a motor power supply stop timing determination routine according to a second embodiment of the present invention.

In the second embodiment, the motor power supply stop timing determination routine of FIG. 7 is executed. Upon starting of the routine, at step 301, it is determined whether rotation of the motor 26 is stopped based on a time interval of pulses outputted from the encoder 29 (or alternatively, a rotational speed of the motor 26 computed based on the time interval of the pulses outputted from the encoder 29). When it is determined that the motor 26 is currently in the rotating state at step 301, the present routine is terminated without executing any of the following steps.

Thereafter, at the time (time t4 in FIG. 8) of sensing the stop of the rotation of the motor 26, the ECU 30 proceeds to step 302. At step 302, the ECU 30 sets the predetermined time period of maintaining the power supply control operation of the motor 26 after the time of sensing the stop of the rotation of the motor 26 based on the temperature of the windings of the motor 26 or related information thereof (e.g., the temperature of another part of the motor 26 other than the windings, the temperature of the EDU 31 or the temperature of the engine 11) within the range that does not cause exceeding of the temperature of the windings of the motor 26 beyond the allowable temperature range. At this time, when the temperature of the windings of the motor 26 is increased, the time required to reach the overheated state is shortened, and vice versa. Thus, the predetermined time period is shortened when the temperature of the windings of the motor 26 is increased, and vice versa.

Thereafter, the ECU 30 proceeds to step 303. At step 303, an elapsed time period CT since the time of sensing the stop of the rotation of the motor 26 is counted. The counting operation for counting the elapsed time period CT is repeated (step 304) until the time of elapsing the predetermined time period, which is set at step 302. Then, at the time (time t5 of FIG. 8) of elapsing the predetermined time period, the ECU 30 proceeds to step 305. At step 305, the power supply control operation of the motor 26 is stopped (prohibited). Thereafter, at step 306, the power supply history flag is placed in the off-state, and the present routine is terminated.

In the second embodiment, the power supply control operation of the motor 26 is stopped (prohibited) after the elapsing of the predetermined time period, which is set based on the temperature of the windings of the motor 26, since the time of sensing the stop of the rotation of the motor 26 based on the output pulse of the encoder 29. Thus, even after the stop of the rotation of the engine 11 (even after the stop of the rotation of the motor 26), the power supply control operation of the motor 26 (variable valve timing control operation) can be maintained within the time range that does not cause the exceeding of the temperature of the windings of the motor 26 beyond the allowable temperature range. Therefore, even when the camshaft 12 is rotated due to, for example, the reverse rotation thereof right after the stop of the engine 11, the motor 26 can be rotated in response to such rotation of the camshaft 12 to correct a deviation in the actual camshaft phase (actual valve timing).

Here, in order to simplify the computing operation, the predetermined time period may be set to a predetermined fixed time period.

Third Embodiment

In the first embodiment, the stop/rotation of the motor 26 is sensed based on the presence/absence of the output pulse of the encoder 29. When the start of the rotation of the motor 26 is sensed, the power supply control operation of the motor 26 is started. In contrast, according to a third embodiment of the present invention shown in FIGS. 9 and 10, the power supply control operation of the motor 26 is started (enabled) when the start of the power supply to a starter (not shown), which cranks the engine 11 at the start time, is sensed.

Figure 9:
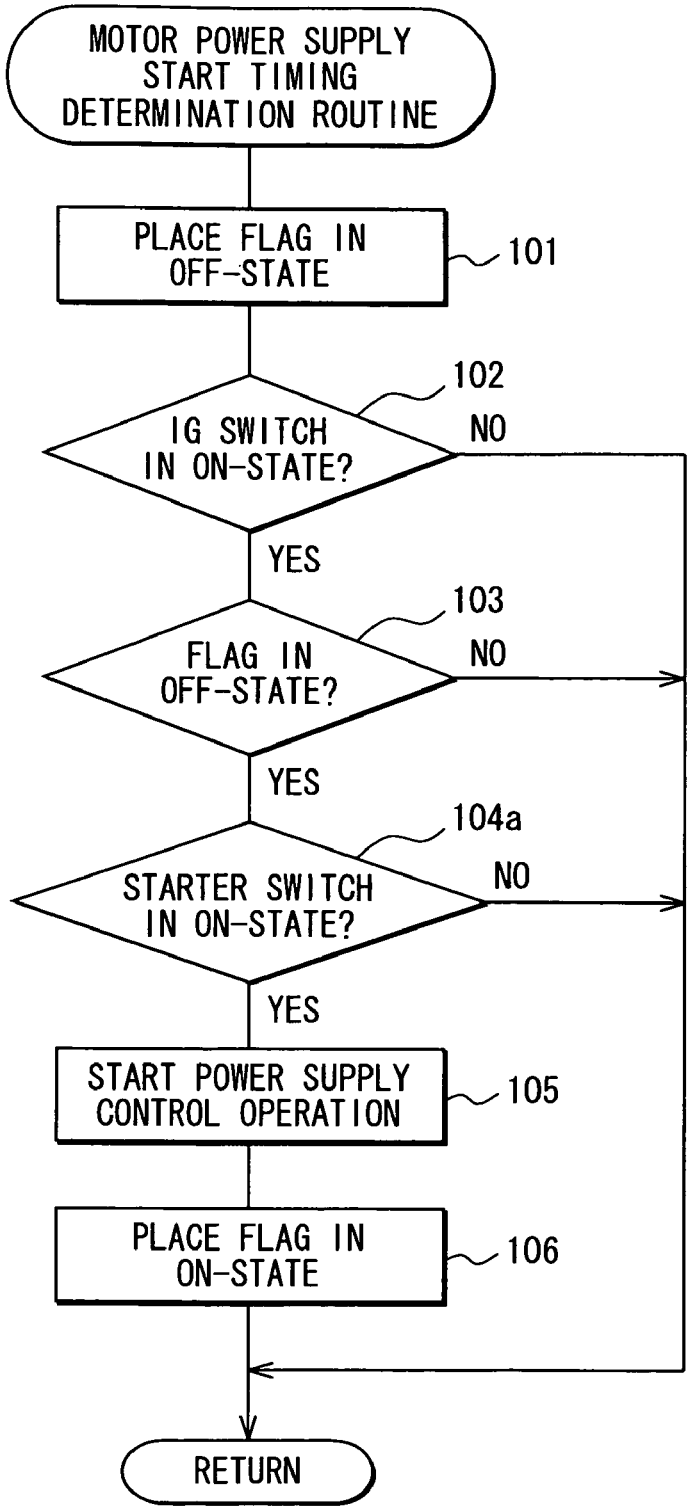
FIG. 9 is a flowchart showing a flow of a motor power supply start timing determination routine according to a third embodiment of the present invention.
Figure 10:
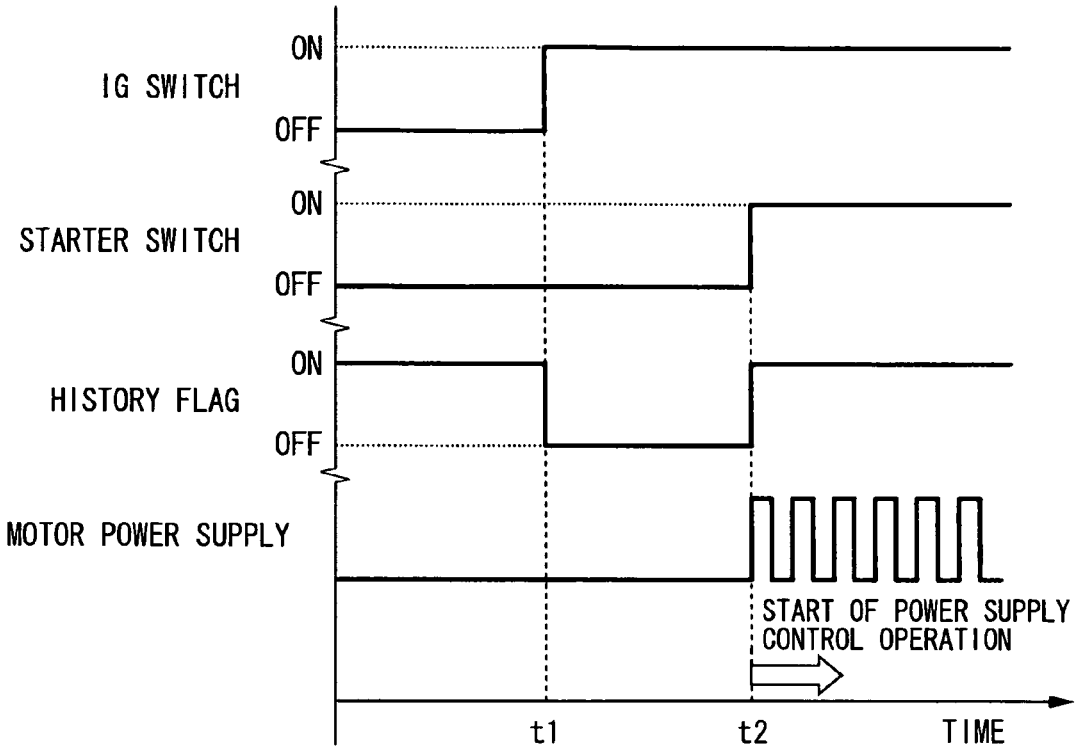
FIG. 10 is a time chart for describing a control method of motor power supply start timing according to the third embodiment.

The motor power supply start timing determination routine of FIG. 9 according to the third embodiment is the same as that of the first embodiment shown in FIG. 3 except that step 104 of FIG. 3 is changed to step 104*a* of FIG. 9.

In the motor power supply start timing determination routine of FIG. 9, after the changing of the power supply history flag from the on-state to the off-state at the time (time t1 of FIG. 10) of placing the IG switch to the on-state first time through steps 101-103, the ECU 30 proceeds to step 104*a*. At step 104*a*, it is determined whether the power supply to the starter is started based on whether a starter switch is placed in an on-state (based on whether an actual starter signal or a starter drive command signal is turned on). Then, at the time (time t2 of FIG. 10) of starting the power supply to the starter upon turning on of the starter switch, the ECU 30 determines that the starter is driven to start the rotation of the motor 26 and thereby proceeds to step 105. At step 105, the power supply control operation (the duty control operation) of the motor 26 is started. Thereafter, at step 106, the power supply history flag is set to the on-state, and then the present routine is terminated. The process of step 104*a* serves as a power supply enabling means.

In the third embodiment, the start of the power supply to the starter is sensed. Thus, the start of the rotation of the engine 11 and the start of the rotation of the motor 26 can be sensed at the early stage at the time of engine start. Therefore, the power supply control operation of the motor 26 (the variable valve timing control operation) can be advantageously started at the early stage at the time of engine start.

The present invention is not limited to the above first to third embodiments. For example, in a case of a vehicle having an idle stop system, which automatically stops an idling operation of the engine upon stopping of the vehicle, the power supply control operation of the motor 26 may be started (enabled) at the time of satisfying a restart condition (at the time of generation of a restart request) through, for example, depressing of a gas pedal by a driver or turning on of an air conditioner during the idle stop period.

Furthermore, the present invention is not limited to the variable valve timing control system of the intake valves and may be alternatively or additionally applied to a variable valve timing control system of the exhaust valves. Furthermore, the phase variable mechanism of the variable valve timing apparatus 18 is not limited to the planetary gear mechanism of the above embodiments and may be changed to any other appropriate phase variable mechanism. That is, the variable valve timing apparatus is only required to be the motor driven variable valve timing apparatus, which changes the valve timing by changing the rotational speed of the motor relative to the rotational speed of the camshaft.

Additional advantages and modifications will readily occur to those skilled in the art. The invention in its broader terms is therefore not limited to the specific details, representative apparatus, and illustrative examples shown and described.

What is claimed is:

1. A control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine, the control device comprising:

a controller for controlling power supply to the electric motor to change a rotational speed of the electric motor relative to a rotational speed of the camshaft and thereby to change the rotational phase of the camshaft relative to the crankshaft; and a motor rotation sensor for sensing stop and rotation of the electric motor; wherein the controller prohibits the controlling of the power supply to the electric motor until starting of rotation of the electric motor is sensed based on a result of the sensing of the motor rotation sensor, and the controller enables the controlling of the power supply to the electric motor when the starting of the rotation of the electric motor is sensed based on the result of the sensing of the motor rotation sensor.

2. The control device according to claim 1, wherein the motor rotation sensor includes an encoder, which outputs pulses that are synchronized with rotation of the electric motor.

3. The control device according to claim 2, wherein the motor rotation sensor senses the stop and rotation of the electric motor based on a rotational speed of the electric motor, which is obtained from time intervals of the pulses outputted from the encoder.

4. A control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine, the control device comprising:

a controller for controlling power supply to the electric motor to change a rotational speed of the electric motor relative to a rotational speed of the camshaft and thereby to change the rotational phase of the camshaft relative to the crankshaft; and a motor rotation sensor for sensing stop and rotation of the electric motor; wherein the controller prohibits the controlling of the power supply to the electric motor when stopping of rotation of the electric motor is sensed based on a result of the sensing of the motor rotation sensor, and the controller enables the controlling of the power supply to the electric motor when the starting of the rotation of the electric motor is sensed based on the result of the sensing of the motor rotation sensor.

5. A control device for an electrically driven variable valve timing apparatus, which uses an electric motor as a drive source to change a rotational phase of a camshaft relative to a crankshaft and thereby to change valve timing of one of an intake valve and an exhaust valve in an internal combustion engine, the control device comprising:

a controller for controlling power supply to the electric motor to change a rotational speed of the electric motor relative to a rotational speed of the camshaft and thereby to change the rotational phase of the camshaft relative to the crankshaft; and a motor rotation sensor for sensing stop and rotation of the electric motor; wherein the controller disables the controlling of the power supply to the electric motor when a predetermined time period elapses upon sensing of stopping of rotation of the electric motor based on a result of the sensing of the motor rotation sensor, and the controller enables the controlling of the power supply to the electric motor while the rotation of the electric motor is sensed based on the result of the sensing of the motor rotation sensor.

6. The control device according to claim 5, wherein the controller sets the predetermined time period based on a temperature of windings of the electric motor or information related thereto.

7. The control device according to claim 6, wherein the controller reduces the predetermined time period when the temperature of the windings of the electric motor is increased.

* * * * *